US006830270B2

(12) United States Patent
Ellis et al.

(10) Patent No.: US 6,830,270 B2
(45) Date of Patent: Dec. 14, 2004

(54) WINDOW LATCH MOUNTING ARRANGEMENT

(75) Inventors: Frederick G. Ellis, Winnipeg (CA); Gerald Bruce Hiebert, Winnipeg (CA)

(73) Assignee: Inductec Alchemist (1987) Inc., Winnipeg (CA)

( * ) Notice: Subject to any disclaimer, the term of this patent is extended or adjusted under 35 U.S.C. 154(b) by 0 days.

(21) Appl. No.: 10/299,666

(22) Filed: Nov. 20, 2002

(65) Prior Publication Data

US 2004/0094968 A1 May 20, 2004

(51) Int. Cl.[7] ..... E05C 3/14

(52) U.S. Cl. ..... 292/241; 292/101; 292/202; 292/348; 292/DIG. 20; 292/DIG. 30; 292/DIG. 33; 292/DIG. 47; 292/DIG. 53

(58) Field of Search ..... 292/96, 100, 101, 292/145, 241, 137, 348, DIG. 53, 242, 202, 95, 114, DIG. 20, DIG. 30, DIG. 33, DIG. 47

(56) References Cited

U.S. PATENT DOCUMENTS

| | | | | | |
|---|---|---|---|---|---|
| 1,445,304 | A | * | 2/1923 | Dresner | 292/67 |
| 1,569,697 | A | * | 1/1926 | Barclay | 292/126 |
| 1,629,438 | A | * | 5/1927 | Dake | 292/136 |
| 2,613,525 | A | * | 10/1952 | Holmsten | 70/89 |
| 2,755,119 | A | * | 7/1956 | Abel | 292/11 |
| 3,039,837 | A | * | 6/1962 | Poe | 312/332.1 |
| 3,153,553 | A | * | 10/1964 | Sandor | 292/336.3 |
| 3,157,420 | A | * | 11/1964 | Sulkowski | 292/288 |
| 3,270,536 | A | * | 9/1966 | Sprung | 70/89 |
| 3,593,547 | A | * | 7/1971 | Taylor | 70/89 |
| 4,038,718 | A | * | 8/1977 | Reilhac et al. | 292/336.3 |
| 4,610,472 | A | * | 9/1986 | Billingsley | 292/54 |
| 4,674,777 | A | * | 6/1987 | Guelck | 292/101 |
| 4,707,006 | A | * | 11/1987 | Garg et al. | 292/336.3 |
| 4,951,486 | A | * | 8/1990 | Braun et al. | 70/208 |
| 5,145,221 | A | * | 9/1992 | Pennebaker et al. | 292/175 |
| 5,172,520 | A | * | 12/1992 | Hostetler et al. | 49/449 |
| 5,414,899 | A | * | 5/1995 | Raetz | 16/380 |
| 5,489,131 | A | * | 2/1996 | Blom | 292/101 |
| 5,536,052 | A | * | 7/1996 | Maier | 292/63 |
| 5,638,709 | A | * | 6/1997 | Clavin | 70/208 |
| 5,806,900 | A | * | 9/1998 | Bratcher et al. | 292/137 |
| 5,820,175 | A | * | 10/1998 | Clavin | 292/165 |
| 5,927,771 | A | * | 7/1999 | Simon et al. | 292/241 |
| 6,139,074 | A | * | 10/2000 | Barnett et al. | 292/240 |
| D435,429 | S | * | 12/2000 | Barnett et al. | D8/338 |
| 6,174,007 | B1 | * | 1/2001 | Schlack et al. | 292/336.3 |
| 6,183,024 | B1 | * | 2/2001 | Schultz et al. | 292/175 |
| RE37,916 | E | * | 12/2002 | Szapucki et al. | 292/175 |

FOREIGN PATENT DOCUMENTS

| | | | | |
|---|---|---|---|---|
| GB | 2158140 | A | * 11/1985 | E05C/3/04 |

* cited by examiner

*Primary Examiner*—Robert J. Sandy
*Assistant Examiner*—Thomas Ho
(74) *Attorney, Agent, or Firm*—Adrian D. Battison; Michael R. Williams; Ryan W. Dupuis

(57) ABSTRACT

A window latch for use with a window frame comprises a main body having a top portion and a bottom portion. A locking member extending through the main body pivotally mounting therein having a lock arm extending out the bottom portion and a manually operable handle exposed at the top portion. A shoulder separating the top and bottom portion so that the bottom portion projects downwardly from the shoulder. A flange portion at one end of the bottom portion projecting along the main body generally parallel to the shoulder and spaced from the shoulder leaving a recess therebetween. Wherein the bottom portion is arranged to be inserted into a hole cut into a top wall of a window frame such that shoulder sits on a top surface of the top wall and the flange engages underneath a lip of the top wall with the lip being received in the recess thus supporting the respective end of the main body to the frame and a fastener for holding an opposed end of the main body within the hole in the frame.

3 Claims, 3 Drawing Sheets

43
5
13
15
1
19
42
17
7
25
11
23
27
29
9
51
53
55
41
21
47
49
45

WINDOW LATCH MOUNTING ARRANGEMENT

FIELD OF INVENTION

The present invention relates to a mounting arrangement for a window latch.

BACKGROUND OF THE INVENTION

Window locks are known in the art that are generally attached to a frame of a window using a plurality of methods of attaching the locks to the frame. Generally, fasteners such as screws and the like are used to attach the lock to window frames. It is preferred in construction to have an aesthetically pleasing lock arrangement for the windows as well as having a convenient and effective fastening arrangement.

SUMMARY OF THE INVENTION

According to an aspect of the present invention there is provided 1. A window latch for use with a window frame comprises:

a main body having a top portion and a bottom portion;

a locking member extending through the main body pivotally mounting therein having a lock arm extending out the bottom portion and a manually operable handle exposed at the top portion;

a shoulder separating the top and bottom portion so that the bottom portion projects downwardly from the shoulder;

a flange portion at one end of the bottom portion projecting along the main body generally parallel to the shoulder and spaced from the shoulder leaving a recess therebetween;

wherein the bottom portion is arranged to be inserted into a hole cut into a top wall of a window frame such that shoulder sits on a top surface of the top wall and the flange engages underneath a lip of the top wall with the lip being received in the recess thus supporting the respective end of the main body to the frame;

and a fastener for holding an opposed end of the main body within the hole in the frame.

Preferably the recess between the flange and the shoulder is of sufficient thickness to receive top wall.

Preferably the flange and the recess are arranged only at said one end.

Alternatively the fastener comprises a projection at the bottom portion which is arranged to snap onto the top surface at an end opposite the step.

Conveniently the fastener comprises a screw for engaging into a receiving hole in the bottom portion at the opposite end.

Preferably the locking member is pivotal about an axis transverse to the main body.

According to a second aspect of the present invention there is provided a combination of window frame and latch therefor, the window frame having;

a frame member defined by a top wall and a parallel bottom wall;

a first hole in the top wall such that the top wall has an outer lip;

a second hole in the bottom wall being than the hole in the top wall;

the latch comprising:

a main body having a top portion and a bottom portion;

a locking member extending through the main body pivotally mounting therein having a lock arm extending out the bottom portion and a manually operable handle exposed at the top portion;

a shoulder separating the top and bottom portion so that the bottom portion projects downwardly from the shoulder;

a flange portion at one end of the bottom portion projecting along the main body generally parallel to the shoulder and spaced from the shoulder leaving a recess therebetween;

the bottom portion being inserted through the first hole cut into the top wall of a window frame such that shoulder sits on a top surface of the top wall and the flange engages underneath the lip of the top wall with the lip being received in the recess thus supporting the respective end of the main body to the frame;

the bottom portion having a bottom surface parallel to the shoulder sitting in contact with a top surface of the bottom wall and a fastener for holding an opposed end of the main body within the first hole in the frame.

Conveniently the recess between the flange and the shoulder is of sufficient thickness to receive the top wall.

Preferably the flange and the recess are arranged only at said one end.

Preferably the fastener comprises a projection at the bottom portion which is arranged to snap onto the top wall at an end opposite the step.

Alternatively the fastener comprises a screw for engaging through the bottom wall into a receiving hole in the bottom portion at the opposite end.

Conveniently the locking member is pivotal about an axis transverse to the main body.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
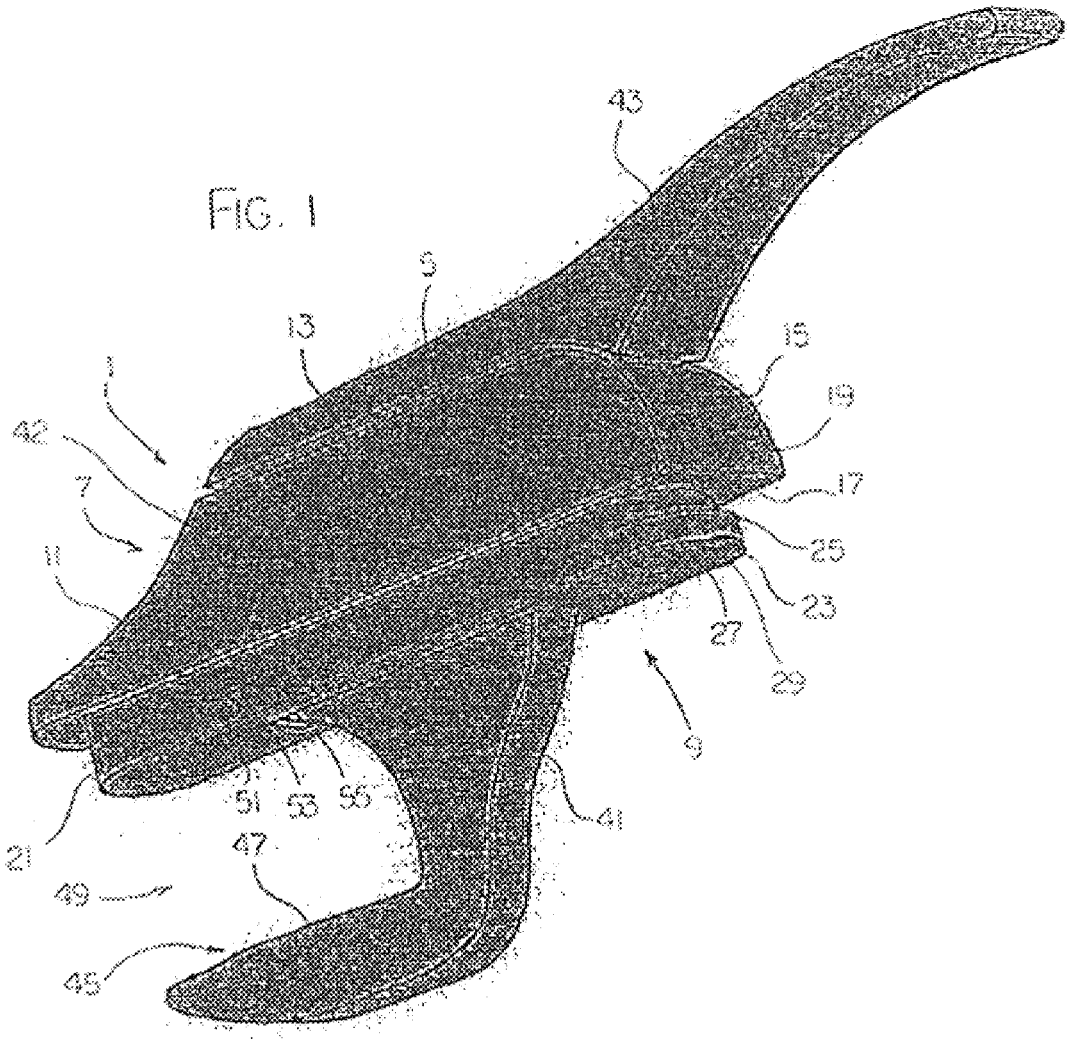
FIG. 1 is an isometric view from the bottom rear of the present invention.
Figure 2:
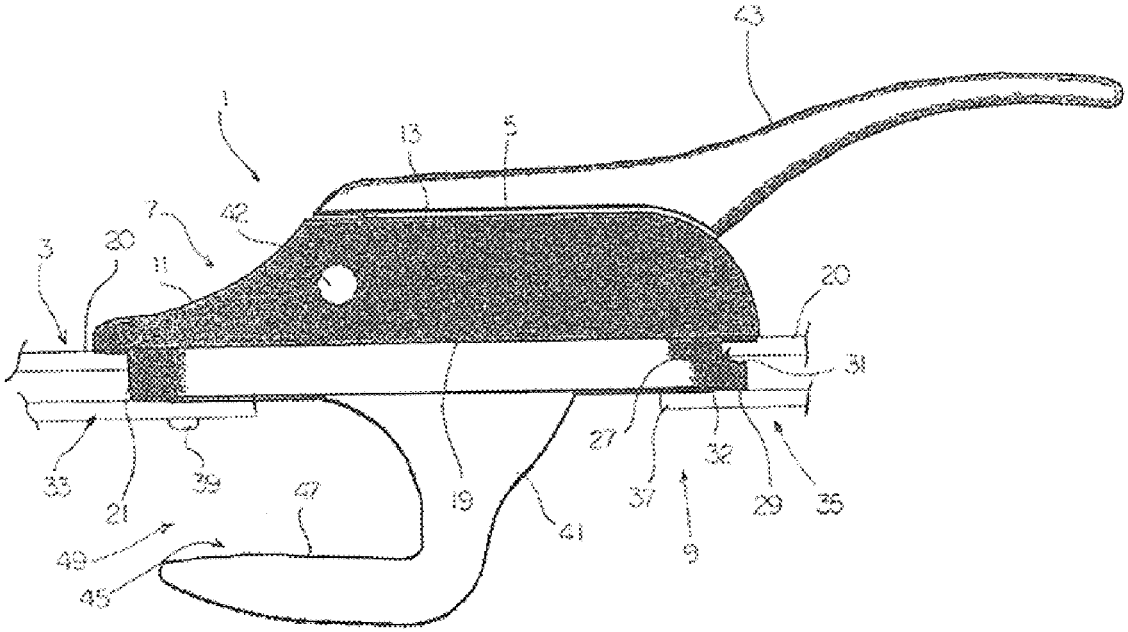
FIG. 2 is a side elevational view of the present invention mounted in cross section in a window frame.
Figure 3:
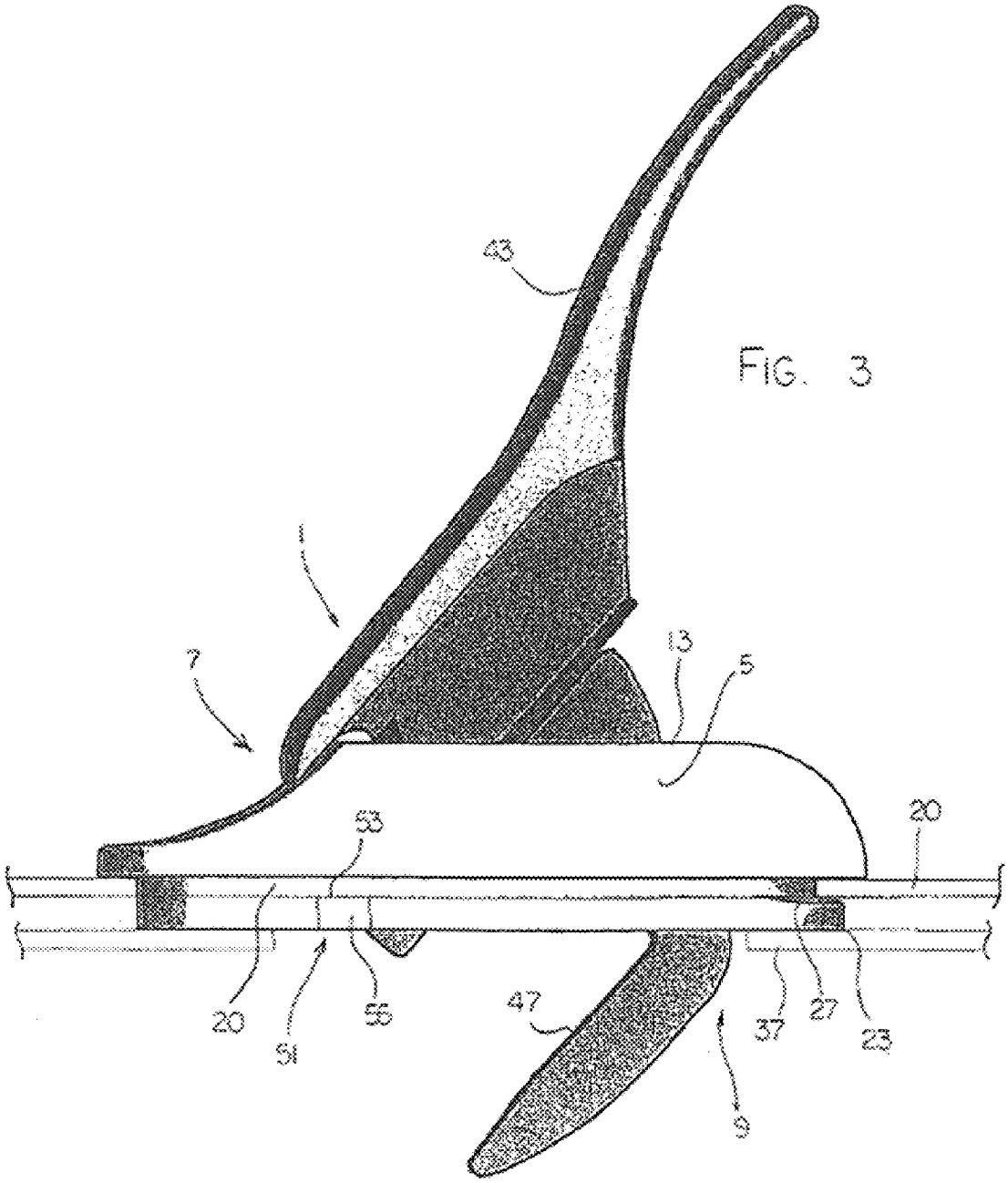
FIG. 3 is a side elevational view as illustrated in FIG. 2 in an open position.

As illustrated in FIGS. 1 through 3, a window latching mechanism 1 is arranged to be mounted to a window sill 3 and engage a locking bar, not shown, for locking a window. The latching mechanism has a main body 5. The main body has a top portion 7 and a bottom portion 9. The window has a frame 12 which has a top surface 20 and a bottom surface 37.

The top portion has a contoured front end 11 extending upwards to a top side 13. A rear end 15 of the top portion extends downwards from the top side. A bottom side 17 of the top portion has a shoulder 19 of the top portion is arranged to engage a top surface 20 of the sill. The top portion is designed to be aesthetically appealing and current to the window latch market.

The bottom portion extends from the bottom side of the top portion such that the shoulder extends outwards around the bottom portion. The bottom portion is arranged to be positioned within the frame leaving the top portion exposed. The bottom portion is sized smaller than the top portion and is shaped to fit into a cut out in the top surface of the sill. In the particular example, illustrated, the bottom portion has a front end 21 adjacent and beneath the front end of the top portion. The bottom portion extends partially along the length of the top portion to a rear end 23. The rear end of the bottom portion is adjacent and below the rear end of the top portion. The rear end of the bottom portion has a flange 25. The flange has a top section 27 and a bottom section 29. The top section is tapered inwards from the rear creating a supporting ledge 31 on the bottom section. The supporting ledge extends downwards from the bottom surface of the top portion and steps rearwards defining recess 32 there between. The recess between the flange and the bottom side of the top portion is sufficiently sized to accept the width of the top surface of the window sill. The top surface of the sill at the rear end is arranged to be cradled such that the rear end is supported therein. The cut out of the sill is sized to wrap around the top section of the bottom portion such that the front end engages a front area 33 of the cut out and a rear area 35 of the cut out is positioned between the bottom section and the shoulder of the top portion. The shoulder of the top portion is arranged to be positioned against the top surface of the sill.

A bottom layer 37 of the sill extends partially beneath the bottom portion such that a screw 39 can be fastened through the bottom layer of the sill into the front end of the bottom portion of the main body. The screw is arranged to support the front end of the main body to the sill and the rear end is supported at the top layer by the supporting ledge.

Installing the window latch, as described above, starts by providing the cut out on the top layer of the sill. The cut out can be done by the installer or can be pre-cut at the factory such that the cut out is sufficiently sized receive the bottom portion within the top surface and the bottom surface is sufficiently sized to abut the bottom side of the bottom portion. The bottom layer of the sill is cut to have a smaller diameter than the top layer cut out such that the bottom layer partially extends beneath and against the bottom side. The installer slides the rear end of the bottom portion into the cut out such that the top layer is inserted into the recess. Once the top layer is in the recess the front end can be inserted into the cut out. Further fastening of the screw provides quick installation of the window latch.

A pivotally mounted locking member 41 extends through the main body from the top end out the bottom end. The locking member is mounted within the main body and has a pivot 42. The locking member has a handle 43 at the top end exposed which can be raised and lowered to lock and unlock the window. A locking clasp 45 extends out the bottom end of the main body and has a hook 47 for engaging a lock bar within the sill which locks the window closed. The hook has an open front end 49 such that raising of the handle on the pivot pulls the hook away from the lock bar, as illustrated in FIG. 3, unlocking the window.

In an alternate embodiment of the latching mechanism, as illustrated in FIGS. 1 and 3, a step 51 on the bottom portion adjacent the front end has a horizontal top side 53 and a upwardly slanted bottom side 55. The top side is spaced from the bottom surface of the top portion such that the top layer of the sill can be positioned therebetween. The step is arranged to receive the top layer, in association with the flange for clipping the latching mechanism to the sill.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A combination comprising:

a fixed window frame and latch mounted thereon, the fixed window frame being arranged for cooperation with a movable window frame such that the latch engages on an element of the movable window frame to hold the movable window frame closed relative to the fixed window frame;

the fixed window frame comprising:

a frame member defined by a first wall having an exposed front surface and an inside surface and a parallel second wall having an inside surface and an exposed rear surface defining a space between the first and second walls;

a first hole through the first wall defining a peripheral lip of the first wall surrounding the first hole;

a second hole in the second wall generally aligned with the first hole and smaller than the first hole;

the latch comprising:

a main body having a first portion for mounting on the exposed front surface of the first wall and a second portion for projecting into the first hole;

the main body having a first end, a second end and two sides extending therebetween;

a locking member extending through the main body pivotally mounted therein having a lock arm portion extending out of the second portion through the second smaller hole for engaging the element of the movable window frame rearwardly of the exposed rear surface of the second wall and a manually operable handle exposed at the first portion such that manual operation of the handle causes pivotal movement of the locking member and the lock arm portion carried thereby relative to the main body;

a shoulder between the first and second portions and arranged parallel to the front surface of the first wall to sit in contact with the front surface with the second portion extending from the shoulder through the first hole;

a flange portion at the first end of the main body projecting from the second portion generally parallel to the shoulder and spaced from the shoulder leaving a recess therebetween;

the flange portion engaging underneath the inside surface of first wall and extending into the space between the first and second walls with a portion of the lip of the first wall at the flange portion received in the recess thus supporting said first end of the main body on the fixed window frame;

the flange portion having a surface generally parallel to the shoulder sitting in contact with the inside surface of the second wall;

and a fastener adjacent the second end of the main body for holding the second end of the main body within the first hole.

2. A combination comprising:

a fixed window frame and latch mounted thereon, the fixed window frame being arranged for cooperation with a movable window frame such that the latch engages on an element of the movable window frame to hold the movable window frame closed relative to the fixed window frame;

the fixed window frame comprising:

a frame member defined by a first wall having an exposed front surface and an inside surface and a parallel second wall having an inside surface and an exposed rear surface defining a space between the first and second walls;

a first hole through the first wall defining a peripheral lip of the first wall surrounding the first hole:

a second hole in the second wall generally aligned with the first hole and smaller than the first hole;

the latch comprising:

a main body having a first portion for mounting on the exposed front surface of the first wall and a second portion for projecting into the first hole;

the main body having a first end, a second end and two sides extending therebetween;

a locking member extending through the main body pivotally mounted therein having a lock arm portion extending out of the second portion through the second smaller hole for engaging the element of the movable window frame rearwardly of the exposed rear surface of the second wall and a manually operable handle exposed at the first portion such that manual operation of the handle causes pivotal movement of the locking member and the lock arm portion carried thereby relative to the main body;

a shoulder between the first and second portions and arranged parallel to the front surface of the first wall to sit in contact with the front surface with the second portion extending from the shoulder through the first hole;

a flange portion at the first end of the main body projecting from the second portion generally parallel to the shoulder and spaced from the shoulder leaving a recess therebetween;

the flange portion engaging underneath the inside surface of first wall and extending Into the space between the first and second walls with a portion of the lip of the first wall at the flange portion received in the recess thus supporting said first end of the main body on the fixed window frame;

the flange portion having a surface generally parallel to the shoulder sitting in contact with the inside surface of the second wall;

and a screw adjacent the second end of the main body for holding the second end of the main body within the first hole, the screw engaging through the second wall from the rear surface thereof into a surface of the second portion of the main body which is in contact with the inside surface of the second wall.

3. A combination comprising:

a fixed window frame and latch mounted thereon, the fixed window frame being arranged for cooperation with a movable window frame such that the latch engages on an element of the movable window frame to hold the movable window frame closed relative to the fixed window frame:

the fixed window frame comprising:

a frame member defined by a first wall having an exposed front surface and an inside surface and a parallel second wall having an inside surface and an exposed rear surface defining a space between the first and second walls;

a first hole through the first wall defining a peripheral lip of the first wall surrounding the first hole;

a second hole in the second wall generally aligned with the first hole and smaller than the first hole;

the latch comprising:

a main body having a first portion for mounting on the exposed front surface of the first wall and a second portion for projecting into the first hole;

the main body having a first end, a second end and two sides extending therebetween;

a locking member extending through the main body pivotally mounted therein having a lock arm portion extending out of the second portion through the second smaller hole for engaging the element of the movable window frame rearwardly of the exposed rear surface of the second wall and a manually operable handle exposed at the first portion such that manual operation of the handle causes pivotal movement of the locking member and the lock arm portion carried thereby relative to the main body;

a shoulder between the first end second portions and arranged parallel to the front surface of the first wall to sit in contact with the front surface with the second portion extending from the shoulder through the first hole:

a flange portion at the first end of the main body projecting from the second portion generally parallel to the shoulder arid spaced from the shoulder leaving a recess therebetween;

the flange portion engaging underneath the inside surface of first wall and extending into the space between the first and second walls with a portion of the lip of the first wall at the flange portion received in the recess thus supporting said first end of the main body on the fixed window frame;

the flange portion having a surface generally parallel to the shoulder sitting in contact with the inside surface of the second wall;

and a fastener adjacent the second end of the main body for holding the second end of the main body within the first hole, the fastener comprising a projection from a side surface of the second portion which is arranged to snap under the inside surface of the first wall.

* * * * *